United States Patent [19]

Wilson

[11] 4,032,053

[45] June 28, 1977

[54] ARTICLE CARRIER WITH HANDLE FEATURE

[75] Inventor: Jerry F. Wilson, Monroe, La.

[73] Assignee: Olinkraft, Inc., West Monroe, La.

[22] Filed: June 30, 1976

[21] Appl. No.: 701,274

[52] U.S. Cl. ..... 224/45 AB; 206/428; 229/51 D

[51] Int. Cl.[2] ..... A45C 11/24

[58] Field of Search ..... 224/45 R, 45 A, 45 AA, 224/45 AB, 45 BA, 48 R, 48 B; 206/427, 428, 170; 229/51 D, 52 B

[56] References Cited

UNITED STATES PATENTS

| | | | |
|---|---|---|---|
| 2,659,524 | 11/1953 | McElwee | 229/51 D |
| 2,723,027 | 11/1955 | Guyer | 206/428 |
| 2,975,934 | 3/1961 | Powell | 229/51 DB X |
| 3,189,215 | 6/1965 | Currie, Jr. | 229/52 B X |
| 3,197,116 | 7/1965 | Zastrow | 229/52 B |
| 3,347,446 | 10/1967 | Guyer et al. | 229/51 D X |
| 3,620,438 | 11/1971 | Wood et al. | 229/51 D X |
| 3,692,232 | 9/1972 | Helms | 229/52 B |
| 3,894,681 | 7/1975 | Arneson et al. | 229/51 D X |

*Primary Examiner*—Robert J. Spar
*Assistant Examiner*—Donald W. Underwood
*Attorney, Agent, or Firm*—O'Brien & Marks

[57] ABSTRACT

A wrap-around type article carrier has removable tear-away panels formed in its top panel so that access may be had to the carrier contents, while a handle is formed between the tear-away panels so that the carrier can be carried after they are removed. The carrier is particularly adapted for use with returnable beverage type containers in which carrying means are necessary to return the carrier and bottles to the retailer.

1 Claim, 4 Drawing Figures

ARTICLE CARRIER WITH HANDLE FEATURE

BACKGROUND OF THE INVENTION

1. Field of the Invention

The invention relates to articles carriers in general and is particularly suited to wrap-around type carriers for transporting beverage bottles.

2. Description of the Prior Art

It has been a general practice in the packaging art for some time to utilize wrap-around type article carriers for non-returnable beverage bottles. Such carriers were typically provided with a pair of holes in the top for carrying. These carriers are particularly advantageous to use because they provide strong carriers while being easier to manufacture and using less material than other carriers. Heretofore, however, wrap-around carriers have been limited in use to non-returnable bottles because gaining access to the contents of such carriers typically involves destroying the carrier. Therefore the advantages and economies of wrap-around type carriers have heretofore not been applicable to carriers for returnable bottles.

SUMMARY OF THE INVENTION

The invention is summarized in that a wrap-around article carrier includes a bottom panel with two sides, a side panel upstanding from each side of the bottom panel, a top panel joined to each of the side panels, first and second tear-away panels formed in the top panel and adapted to being torn from the carrier to allow the articles to be removed through the top of the carrier, and a handle portion formed between the first and second tear-away panels and extending between the side panels so that the carrier can be carried.

An object of the present invention is to provide a wrap-around type article carrier in which access can be made to the contents of the carrier without completely destroying the carrier.

Another object of the present invention is to construct such a carrier in which a carrying handle is provided that is usable both for taking home the full bottles and for returning the empty bottles to the retailer.

An advantage of the present invention is that it allows the advantages and economies of wrap-around type carriers to be used for a carrier for returnable bottles.

Other objects, advantages and features of the present invention will become apparent from the foregoing specification when taken together with the accompanying drawings.

DESCRIPTION OF THE PREFERRED EMBODIMENT

Figure 1:
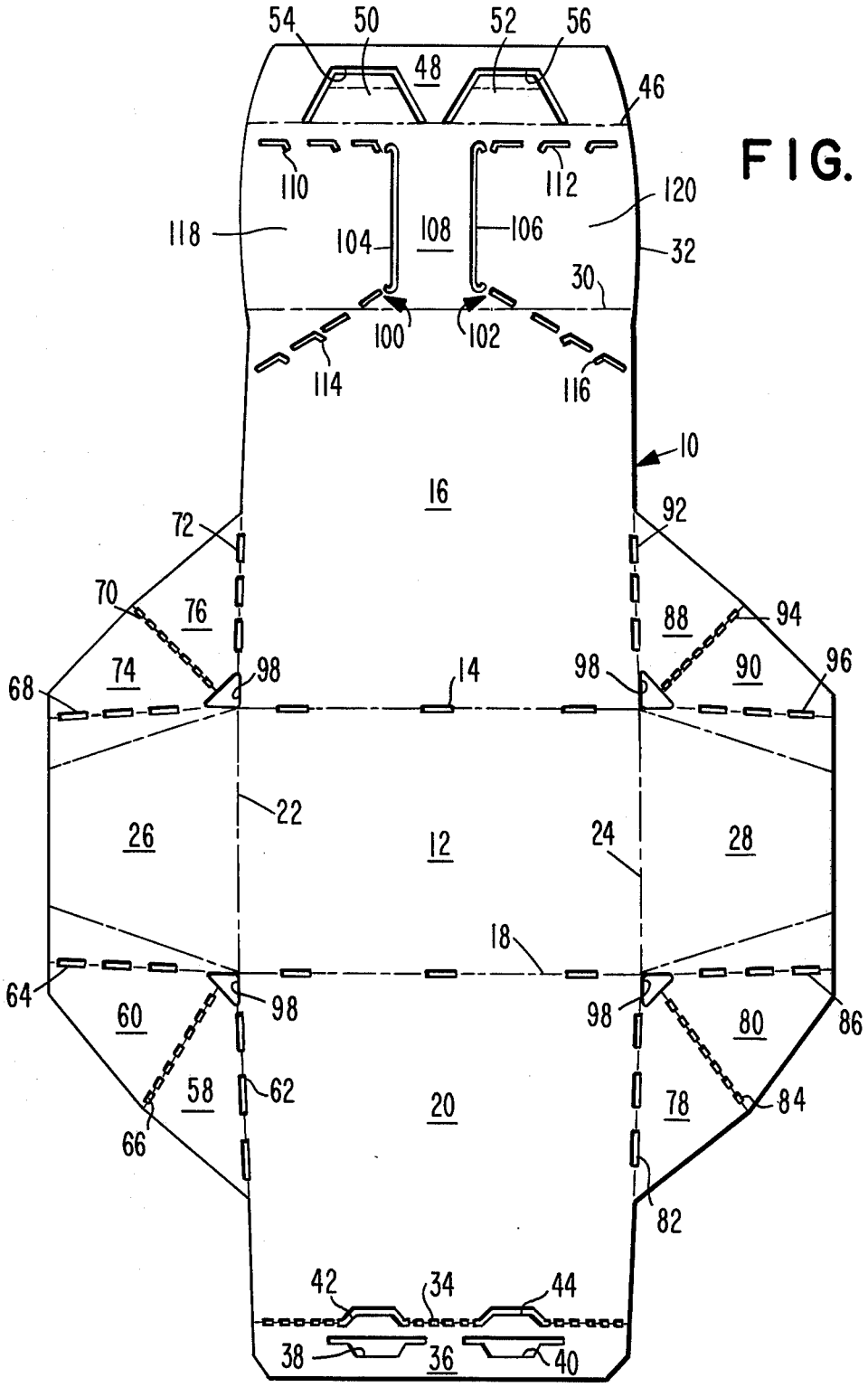
FIG. 1 is a plan view of a paperboard blank from which the article carrier of the present ivention is constructed.

Shown in FIG. 1 is a paperboard blank, generally indicated at 10, from which an article carrier according to the present invention can be erected. Centrally located in the blank 10 is a rectangular bottom panel 12.

A scoreline 14 connects the bottom panel 12 along one of its long sides to a side panel 16. A scoreline 18 along the other long side of the bottom panel 12 connects it to a side panel 20. A pair of scorelines 22 and 24 lie along the opposite short ends of the bottom panel 12 and attach respective end panels 26 and 28 to the bottom panel 12. A scoreline 30 at the edge of the side panel 16 opposite from the bottom panel 12 connects a top panel 32 to the side panel 16.

The edge of the side panel 20 opposite from the bottom panel 12 is defined by a scoreline 34 which attaches a locking flap 36 to the side panel 20. The locking flap 36 has a pair of die-cut secondary locking recesses 38 and 40 formed in it. Also formed by die-cuts along the edge of the locking flap 36 adjacent the side panel 20 are a pair of primary locking tabs 42 and 44. A scoreline 46 along the edge of the top panel 32 opposite from the side panel 16 attaches a locking flap 48 to the side panel 16. The locking flap 48 has die-cuts in it to define secondary locking tabs 50 and 52 and primary locking surfaces 54 and 56.

A pair of tuck flaps 58 and 60 extend between the side panel 20 and the end panel 26 with a scoreline 62 connecting the tuck flap 58 to the side panel 20, a scoreline 64 connecting the tuck flap 60 to the end panel 26, and a scoreline 66 connecting the tuck flap 58 to the tuck flap 60. Similarly scoreline 68, 70 and 72 connect the end panel 26 to a tuck flap 74, the tuck flap 74 to a tuck flap 76, and the tuck flap 76 to the side panel 16. On the opposite side of the blank 10, tuck flaps 78 and 80 are defined by scorelines 82, 84 and 86 to bridge between the side panel 20 and the end panel 28. Tuck flaps 88 and 90 are defined by scorelines 92, 94 and 96 to extend between the side panel 16 and the end panel 28. Triangular holes 98 are cut into the corners of each of the sets of tuck flaps 58 and 60, 74 and 76, 78 and 80 and 88 and 90 to facilitate in folding them.

In the top panel 32 and the side panel 16, a pair of tear-away section die-cuts are generally indicated by 100 and 102. Each of the die-cuts 100 and 102 includes a respective one of transverse oriented handle die-cuts 104 and 106, which are formed extending traversely across the top panel 32 and each of which terminates at each of its ends in a hook-shaped portion which curves in the direction of the closer end of the top panel 32. The handle die-cuts 104 and 106 define a handle portion 108 therebetween, the handle portion 108 extending between both edges of the top panel 32. Extending from the hooked end portion of each of the handle die-cuts 104 and 106 adjacent the scoreline 46 are rip guide die-cuts 110 and 112 which extend from the hooked ends of the handle die-cuts 104 and 106 straight to the respective ends of the top panel 32 parallel to the scoreline 46. From the hooked end portion of the handle die-cut 104 adjacent the scoreline 30 a rip guide die-cut 114 extends at a diagonal angle toward the edge of the blank 10, crossing the scoreline 30 and extending across a corner of the side panel 16. Similarly a rip guide die-cut 116 extends from the hooked end of the handle die-cut 106 adjacent the scoreline 30 outward to the edge of the blank 10 in a diagonal direction crossing the scoreline 30 and extending across a portion of the side panel 16. The die-cuts 104, 110 and 114 define a first tear-away panel 118, while the die-cuts 106, 112 and 116 define a second tear-away panel 120.

Figure 2:
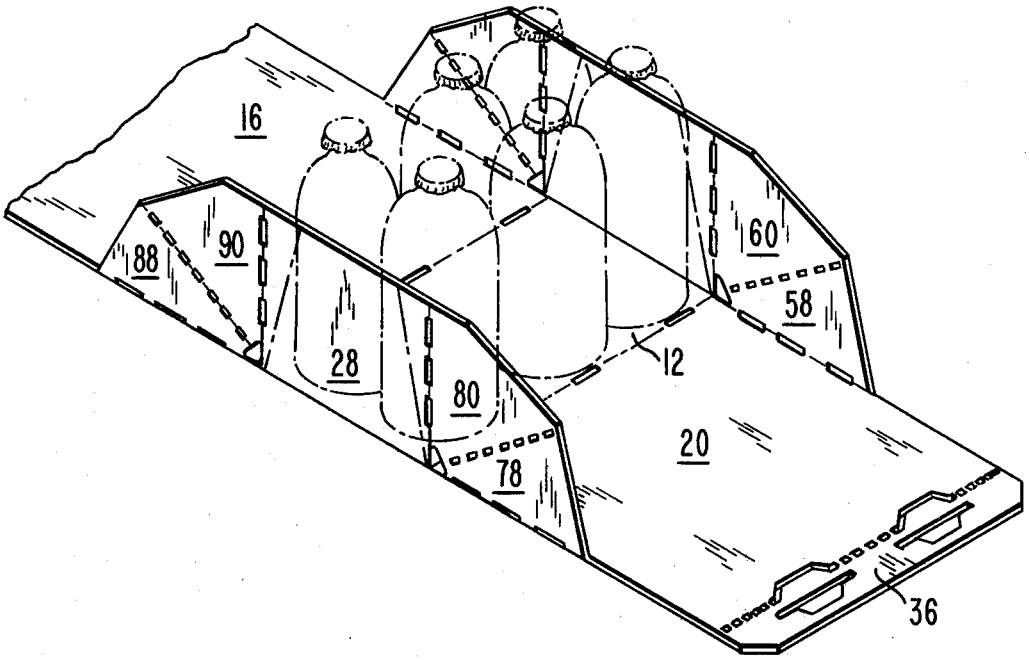
FIG. 2 shows a first step in the erection of the carrier from the blank of FIG. 1.

The first step in the sequence of erecting the finished carrier from the blank 10 is shown in FIG. 2. The articles to be carried in the carrier, in this case six beverage bottles, are grouped and placed on the bottom panel 12 of the blank 10. Next the end panels 26 and 28 are folded upward relative to the bottom panel 12 along the scorelines 22 and 24. As the end panels 26 and 28 are folded up, the tuck panels 58, 60, 74, 76, 78, 80, 88 and 90 are also folded up along the scorelines 62, 72, 82 and 92.

The next step in the erection of the carrier is the wrapping of the blank 10 around the articles. This step is initiated by folding the side panels 16 and 20 upward along the scorelines 14 and 18. As the side panels 16 and 20 are folded upward, the pairs of tuck panels 58 and 60, 74 and 76, 78 and 80, and 88 and 90 are folded inward so that they are tucked between the side panels 16 and 20 and the articles in the carrier. The tuck panels can be secured in place by gluing or stapling in this position if it is found to be so desirable. Then the top panel 32 is folded over along the scoreline 30 to a horizontal position to cover the tops of the bottles. The locking flap 48 is then folded downward along the scoreline 46 and locked with the locking flap 36 to complete the carrier. The lock between the locking flaps 36 and 48 is completed by first bending the secondary locking tabs 50 and 52 up out of the way and then inserting the locking flap 48 inside of the locking flap 36. The locking flap 36 is then tilted back along the scoreline 34 so that the primary locking tabs 42 and 44 are inserted inside of the primary locking surface 54 and 56 of the locking flap 48. The secondary locking tabs 50 and 52 can be folded down and their ends inserted into the secondary locking recesses 38 and 40 to lock the blank in a position to form the completed carrier of FIG. 3.

Figure 3:
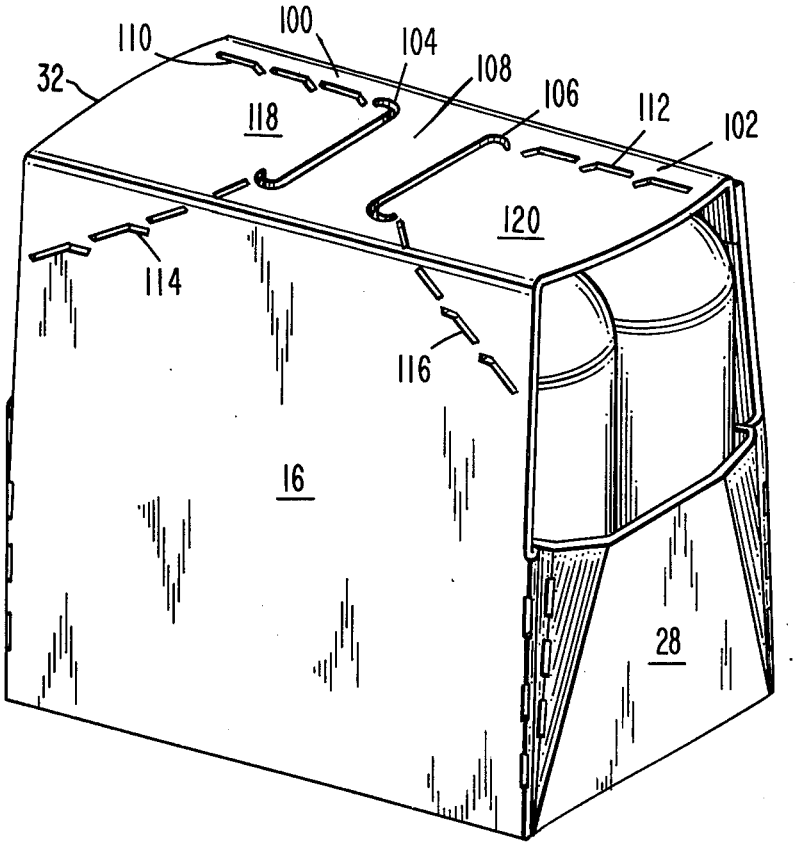
FIG. 3 is a perspective view of the completed article carrier according to the present invention.

The carrier and its contents will normally be sold to the consumer of the goods in the form of the completed carrier of FIG. 3. In this form, the carrier can be carried by inserting fingers into the tear-away panels 118 and 120 in the area directly adjacent the handle die-cuts 104 and 106 to thereby slightly bend in the edges of the tear-away panels 118 and 120 so that fingers can be inserted under handle portion 108 so the carrier can be lifted.

When access is desired to the contents of the carrier, the tear-away panels 118 and 120 can be removed to allow articles in the carrier to be lifted out. The tear-away panels 118 and 120 first have their edges adjacent the handle die-cuts 104 and 106 lifted up. The tear-away panels 118 and 120 are pulled back tearing along the rip guide die-cuts 110 and 114 and 112 and 116 to remove the tear-away panels 118 and 120 completely from the carriers. The handle portion 108 remains in place linking the sides of the carrier as can be seen best in FIG. 4. Then the articles in the carrier can be removed, used, and replaced with facility. The carrier of FIG. 4 has lost none of its strength or integrity because of the removal of the tear-away panels 118 and 120. The slanted angle of the die-cuts 114 and 116 creates a larger opening so that the articles can be freely removed and replaced through that opening. The rip guide die-cuts 110 and 112 are positioned so that the integrity of the lock between the locking flaps 36 and 48 is in no way impaired.

Figure 4:
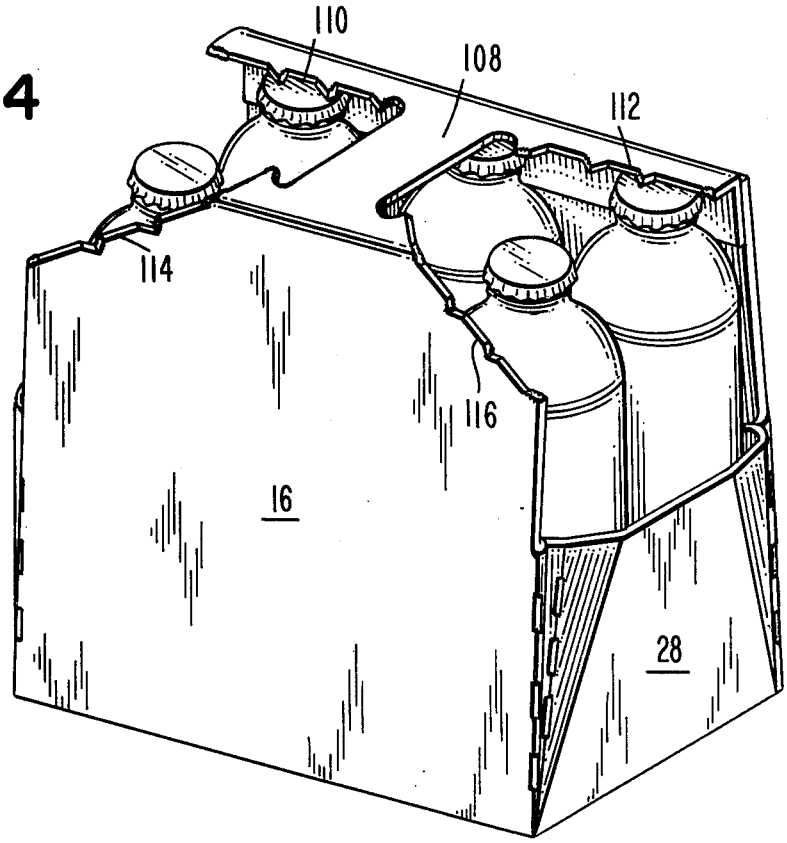
FIG. 4 is a perspective view of the carrier of FIG. 3 with the tear-away panels removed.

The carrier of FIGS. 3 and 4 is thus particularly useful for returnable-type beverage bottles. The bottles can be lifted from the open top of the carrier, used, and then replaced in the carrier. When all the bottles are used up, the carrier can be used to return the bottles to the retailer, the carrier being lifted by the handle portion 108. The carrier remains sturdy enough to carry the empties back, the removal of the tear-away panels 118 and 120 not significantly effecting the strength of the carrier. Thus a wrap-around carrier can be constructed for returnable bottles.

Inasmuch as the subject invention is subject to many modifications, variations, and changes in detail, it is intended that all the material in the specification or in the accompanying drawings be interpreted as illustrative, and not in a limiting sense.

What is claimed is:

1. An article carrier comprising a bottom panel with two sides and two ends, a side panel upstanding from each side of the bottom panel, end panel means extending across the ends of the carrier for retaining the articles in the carrier, a top panel extending between the side panels and having two ends, a scoreline connecting the top panel to a first one of the side panels, locking flap means connecting the top panel to a second one of the side panels, a pair of transverse handle die-cuts formed in the top panel, a pair of rip guide die-cuts for each handle die-cut extending from the respective handle die-cut to one of the ends of the carrier, and a handle portion defined between the handle die-cuts, a first one of each pair of rip guide die-cuts extending at a diagonal angle so that it extends onto the first one of the side panels, a second one of each pair of rip guide die-cuts extending straight from the respective handle die-cut to the end of the top panel.

* * * * *